US006119912A

United States Patent [19]

Peck

[11] Patent Number: 6,119,912

[45] Date of Patent: Sep. 19, 2000

[54] NAIL GUN ATTACHMENT

[76] Inventor: William A. Peck, P.O. Box 345, Park City, Utah 84060

[21] Appl. No.: 09/204,494

[22] Filed: Dec. 3, 1998

[51] Int. Cl.[7] ..... B27F 7/00

[52] U.S. Cl. ..... 227/120; 173/20; 227/110; 227/156

[58] Field of Search ..... 227/120, 156, 227/110, 140, 151, 76, 131; 173/20, 21; 116/230; 30/293

[56] References Cited

U.S. PATENT DOCUMENTS

| | | | |
|---|---|---|---|
| 2,959,859 | 11/1960 | Weiss | 227/156 |
| 2,975,424 | 3/1961 | Oussani | 227/131 |
| 3,125,761 | 3/1964 | Adams | 227/151 |
| 3,437,156 | 4/1969 | Laverty | 173/21 |
| 3,524,575 | 8/1970 | Hurkmans et al. | 227/131 |
| 3,543,868 | 12/1970 | Drake | 173/21 |
| 4,204,625 | 5/1980 | Glenn | 227/110 |
| 4,207,953 | 6/1980 | Reibetanz et al. | 173/21 |
| 5,261,588 | 11/1993 | Lin | 227/156 |
| 5,471,750 | 12/1995 | Deboi | 30/293 |
| 5,495,784 | 3/1996 | Chen | 116/230 |
| 5,918,790 | 7/1999 | Donnell | 227/156 |

*Primary Examiner*—Peter Vo
*Assistant Examiner*—Jim Calve

[57] ABSTRACT

A gauge adapted for use with a nail gun is provided including an elongated member. A plurality of adjustable stops are each slidably situated on the elongated member and securable thereon at selected points.

8 Claims, 3 Drawing Sheets

NAIL GUN ATTACHMENT

BACKGROUND OF THE INVENTION

1. Field of the Invention

The present invention relates to nail guns and more particularly pertains to a new nail gun attachment for providing consistent measurements between the points where perimeter and field nails are driven, as well as a way of identifying the location of wall studs.

2. Description of the Prior Art

The use of nail guns is known in the prior art. More specifically, nail guns heretofore devised and utilized are known to consist basically of familiar, expected and obvious structural configurations, notwithstanding the myriad of designs encompassed by the crowded prior art which have been developed for the fulfillment of countless objectives and requirements.

Known prior art nail guns and the like include U. S. Pat. No. 5,180,091; U.S. Pat. No. 5,261,588; U.S. Pat. Des. 257,556; U.S. Pat. No. 5,110,027; U.S. Pat. No. 4,570,840; and U.S. Pat. No. 4,246,831.

In these respects, the nail gun attachment according to the present invention substantially departs from the conventional concepts and designs of the prior art, and in so doing provides an apparatus primarily developed for the purpose of providing consistent measurements between the points where perimeter and field nails are driven, as well as a way of identifying the location of wall studs.

SUMMARY OF THE INVENTION

In view of the foregoing disadvantages inherent in the known types of nail guns now present in the prior art, the present invention provides a new nail gun attachment construction wherein the same can be utilized for providing consistent measurements between the points where perimeter and field nails are driven, as well as a way of identifying the location of wall studs.

The general purpose of the present invention, which will be described subsequently in greater detail, is to provide a new nail gun attachment apparatus and method which has many of the advantages of the nail guns mentioned heretofore and many novel features that result in a new nail gun attachment which is not anticipated, rendered obvious, suggested, or even implied by any of the prior art nail guns, either alone or in any combination thereof.

To attain this, the present invention generally comprises a nail gun having a driving cylinder for ejecting nails upon the actuation thereof. The nail gun includes a generally rectangular, closed loop handle coupled to a peripheral side wall thereof and extended therefrom. Mounted on an intersection between the driving cylinder and the handle is a trigger for selectively actuating the driving cylinder. Next provided is a rigid ruler with a generally planar rectangular configuration. The ruler has a front face, a rear face and a periphery formed therebetween. The periphery is defined by a pair of short end edges and a pair of elongated side edges. The front face of the ruler has measurement indicia formed along an entire length thereof between the short end edges, as shown in FIGS. 1 & 2. The rear face of the ruler, on the other hand, has an adhesive formed thereon with a removable backing. The adhesive serves for coupling along a lower edge of the handle and driving cylinder of the nail gun. For reasons that will soon become apparent, the elongated side edges of the ruler each have a V-shaped conduit formed along an entire length thereof. Also included is a plurality of adjustable stops each constructed entirely from a transparent material. As shown in FIG. 5, the adjustable stops each include a planar rectangular strip with a height equal to that of the ruler and a width a fraction of that of the ruler. A pair of rearwardly extending guides are integrally coupled to a top edge and a bottom edge of the strip. Each of the rearwardly extending guides are equipped with a bottom surface with a V-shaped cross-section. By this structure, the guides are adapted for slidably engaging the side edges of the ruler. Each stop further includes a forwardly extending lip coupled to the bottom edge of the strip in perpendicular relationship therewith. A threaded aperture is formed in the strip for releasably receiving a set screw which selectively engages the front face of the ruler for securing the stop in place.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new nail gun attachment apparatus and method which has many of the advantages of the nail guns mentioned heretofore and many novel features that result in a new nail gun attachment which is not anticipated, rendered obvious, suggested, or even implied by any of the prior art nail guns, either alone or in any combination thereof.

It is another object of the present invention to provide a new nail gun attachment which may be easily and efficiently manufactured and marketed.

It is a further object of the present invention to provide a new nail gun attachment which is of a durable and reliable construction.

An even further object of the present invention is to provide a new nail gun attachment which is susceptible of a low cost of manufacture with regard to both materials and labor, and which accordingly is then susceptible of low prices of sale to the consuming public, thereby making such nail gun attachment economically available to the buying public.

Still yet another object of the present invention is to provide a new nail gun attachment which provides in the apparatuses and methods of the prior art some of the advantages thereof, while simultaneously overcoming some of the disadvantages normally associated therewith.

Still another object of the present invention is to provide a new nail gun attachment for providing consistent measurements between the points where perimeter and field nails are driven, as well as a way of identifying the location of wall studs.

Even still another object of the present invention is to provide a new nail gun attachment that includes an elongated member. A plurality of adjustable stops are each slidably situated on the elongated member and securable thereon at selected points.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
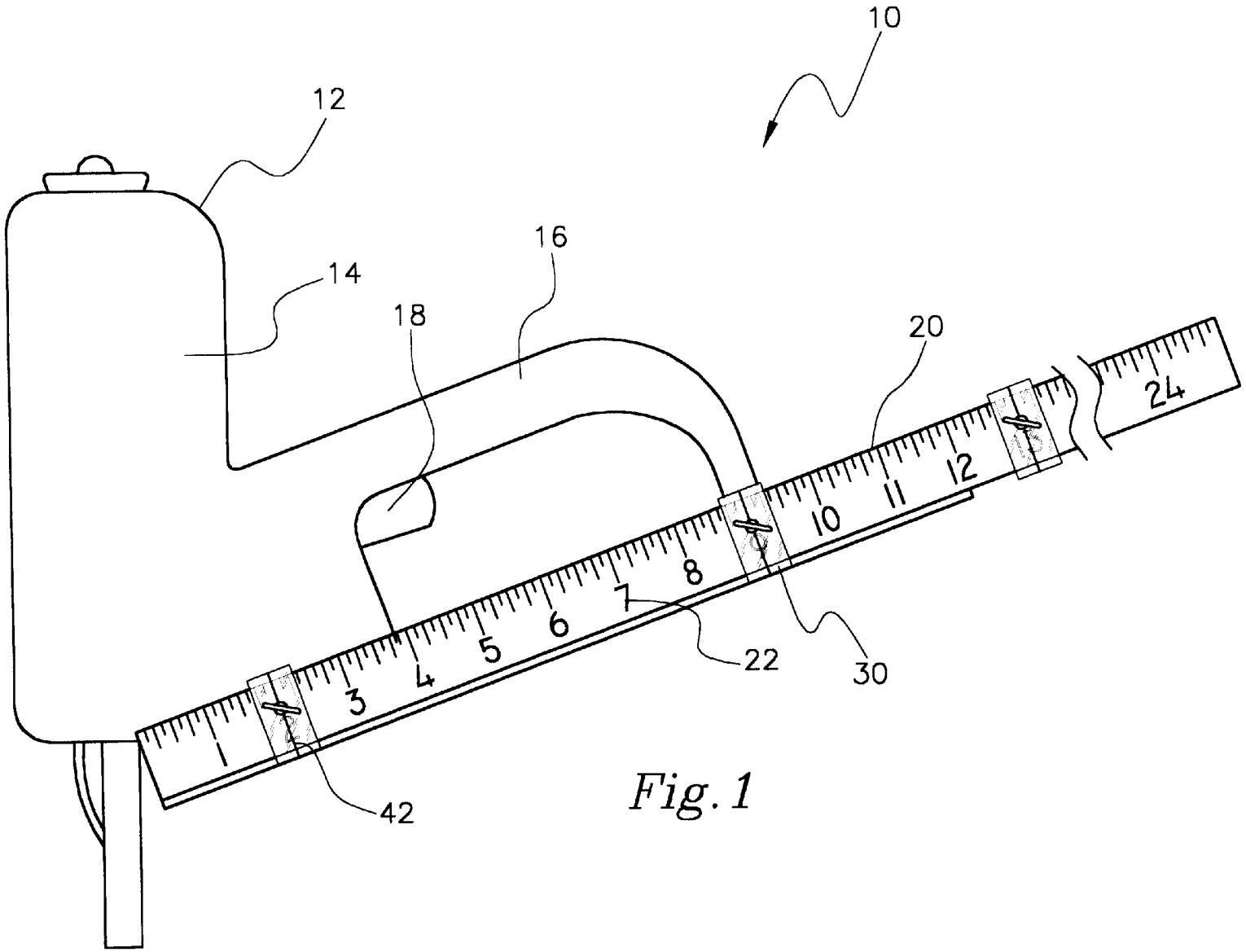
FIG. 1 is a side view of a new nail gun attachment according to the present invention.

With reference now to the drawings, and in particular to FIGS. 1 through 5 thereof, a new nail gun attachment embodying the principles and concepts of the present invention and generally designated by the reference numeral 10 will be described.

The present invention, designated as numeral 10, is adapted for use with a nail gun 12 having a driving cylinder 14 for ejecting nails upon the actuation thereof. The nail gun includes a generally rectangular, closed loop handle 16 coupled to a peripheral side wall thereof and extended therefrom. Mounted on an intersection between the driving cylinder and the handle is a trigger 18 for selectively actuating the driving cylinder.

Figure 2:
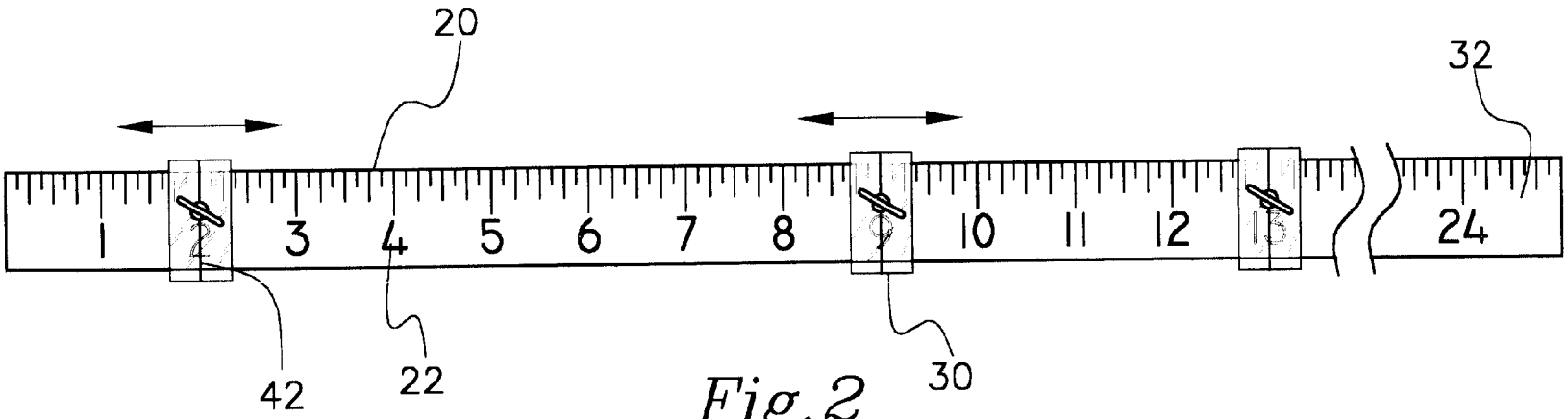
FIG. 2 is a view of a front face of the ruler of the present invention.
Figure 3:
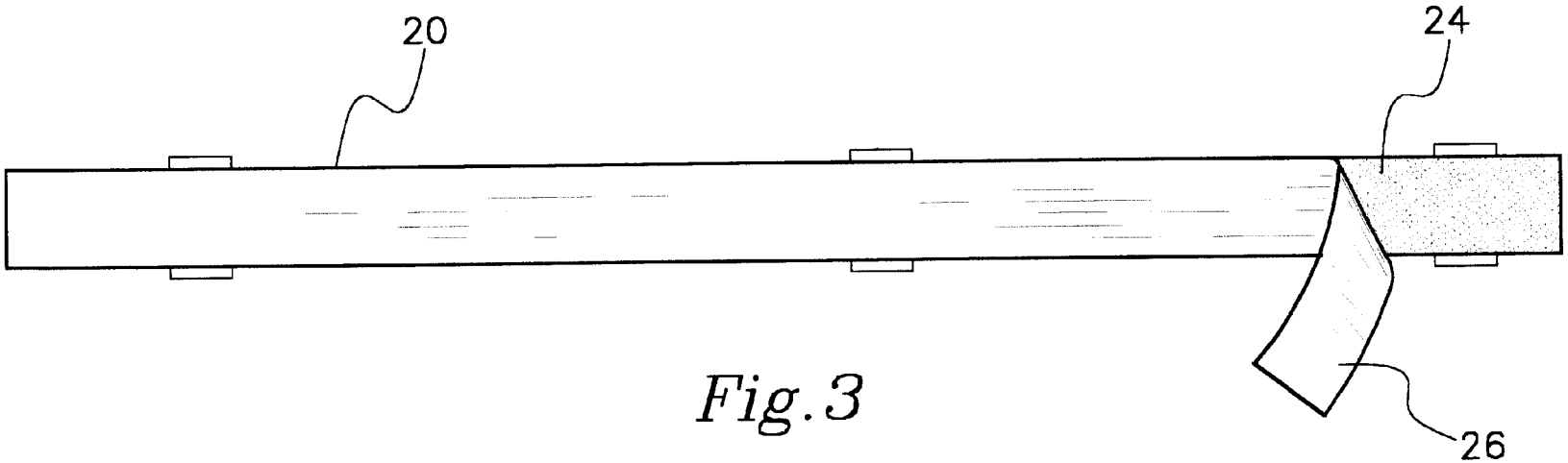
FIG. 3 is a view of a rear face of the ruler of the present invention.
Figure 4:
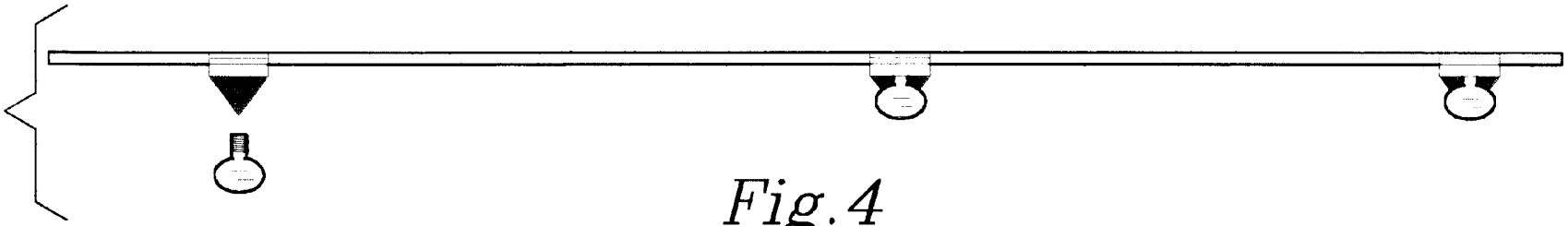
FIG. 4 is a top view of the ruler of the present invention.

Next provided is a 24 inch, rigid ruler 20 with a generally planar rectangular configuration. The ruler has a front face, a rear face and a periphery formed therebetween. The periphery is defined by a pair of short end edges and a pair of elongated side edges. The front face of the ruler has measurement indicia 22 formed along an entire length thereof between the short end edges, as shown in FIGS. 1 & 2.

The rear face of the ruler, on the other hand, has an adhesive 24 formed thereon with a removable backing 26. The adhesive serves for coupling along a lower edge of the handle and driving cylinder of the nail gun. When coupled to the nail gun, the ruler preferably has an end that is in line with and laterally offset from a nail outlet of the driving cylinder. It should be noted that the backing may only be partially severed and removed such that only a required portion of the adhesive is exposed. As shown in FIG. 1, the ruler has a length at least twice that of the nail gun.

For reasons that will soon become apparent, the elongated side edges of the ruler each have a V-shaped conduit 28 formed along an entire length thereof. Further, ends of the V-shaped conduits preferably have unillustrated plugged ends.

Also included is a plurality of adjustable stops 30 each constructed entirely from a transparent material. As shown in FIG. 2, the adjustable stops each include a planar rectangular strip 32 with a height equal to that of the ruler and a width a fraction of that of the ruler. A pair of rearwardly extending guides 34 are integrally coupled to a top edge and a bottom edge of the strip. Each of the rearwardly extending guides are equipped with a bottom surface with a V-shaped cross-section. By this structure, the guides are adapted for slidably engaging the side edges of the ruler.

Figure 5:
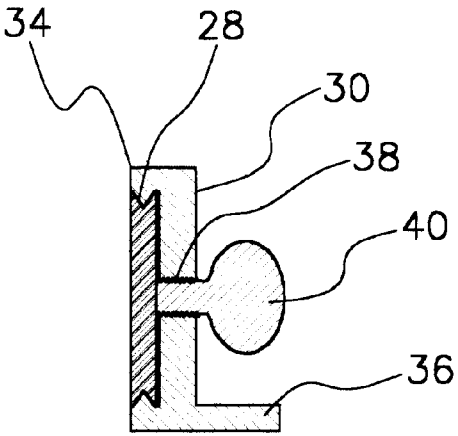
FIG. 5 is a side cross-sectional view of the ruler and one of the stops of the present invention.

Each stop further includes a forwardly extending lip 36 coupled to the bottom edge of the strip in perpendicular relationship therewith. A threaded aperture 38 is formed in the strip for releasably receiving a set screw 40 which selectively engages the front face of the ruler for securing the stop in place. As shown in FIG. 5, the set screw has an outboard disk-shaped portion and an inboard threaded portion. In the preferred embodiment, a vertical line 42 is situated on the rectangular strip and intersects the threaded aperture for gauging purposes. When used on wall studs, the stops are secured distances from the nail outlet of the nail gun which are equal to multiples of the distance between adjacent studs in a wall. As such, after identifying a single stud, a user may simply use the stops to identify the position of adjacent studs.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A nail gun with gauge comprising, in combination:

a nail gun including a driving cylinder with a generally rectangular, closed loop handle coupled to a peripheral side wall thereof and extending therefrom in a generally radial direction and a trigger mounted on an intersection between the driving cylinder and the handle for selectively actuating the driving cylinder;

a rigid ruler with a generally planar rectangular configuration having a front face, a rear face and a periphery formed therebetween defined by a pair of short end edges and a pair of elongated side edges, the front face having measurement indicia formed along an entire length thereof between the short end edges, the rear face having an adhesive formed thereon with a removable backing for coupling along a lower edge of the handle and driving cylinder of the nail gun, the elongated side edges of the ruler each having a V-shaped conduit formed along an entire length thereof with apexes of the conduits residing within a common plane; and a plurality of adjustable stops each constructed entirely from a transparent material, the adjustable stops each including a planar rectangular strip with a height equal to that of the ruler and a width a fraction of that of the ruler, a pair of rearwardly extending guides integrally coupled to a top edge and a bottom edge of the strip each with a bottom surface with a V-shaped cross-section for slidably engaging the side edges of the ruler, a forwardly extending lip coupled to the bottom edge of the strip in perpendicular relationship therewith, and a threaded aperture formed in the strip for releasably receiving a set screw which selectively engages the front face of the ruler for securing the stop in place.

2. A fastener driving system for positioning fasteners to be driven, the system comprising:

a fastener driver having a driving portion with a driving head and a closed loop handle portion, the handle portion extending away from the driving head of the driving portion;

an elongate ruler member mounted on a side of the handle portion with one end positioned at the driving head and one end extending away from the driving head, the ruler having a front face with measurement indicia marked thereon such that the measurement indicia is viewable from a location to a side of the fastener driver when the driving head is directed downwardly for driving a fastener in a downward direction and elongated side edges having a groove formed therein, the measurement indicia originating substantially at the driving head; and a plurality of adjustable stops each slidably situated on the ruler and securable on the ruler at a selected point, the stops each including a top and a bottom portion having a pair of guides integrally coupled thereto, each of the guides having a surface with a V-shaped cross-section for slidably engaging the grooves in the side edges of the ruler and extending adjacent to the measurement indicia on the front face of the ruler such that a distance for each of the stops away from the driving head is viewable from the side of the fastener driver, wherein each of the stops are releasably secured to the ruler by a set of screw received through a threaded aperture formed therein.

3. A gauge as set forth in claim 2 wherein an adhesive secures a rear face of the ruler to the handle portion.

4. A gauge as set forth in claim 2 wherein each stop has a set screw for selectively engaging the ruler.

5. A gauge as set forth in claim 2 wherein three stops are included.

6. A gauge as set forth in claim 2 wherein each stop slides along channels on the rule for precluding the removal of the stop while sliding.

7. A nail gun with gauge comprising:

a nail gun including a driving cylinder, a closed loop handle coupled to the driving cylinder, and a trigger mounted on the handle for selectively actuating the driving cylinder;

a substantially rigid ruler having a front face, a rear face and a periphery formed therebetween defined by a pair of relatively short end edges and a pair of relatively long side edges, the front lace having measurement indicia formed along a length of the ruler between the short end edges, the rear face having an adhesive formed thereon coupling the ruler to a lower edge of the handle and driving cylinder of the nail gun, the elongated side edges of the ruler each having a groove formed therein and extending along a length of the side edges; and a plurality of adjustable stops slidably mounted on the ruler, each constructed entirely from a transparent material, the adjustable stops each including a strip with top and bottom portions, a pair of guides each integrally coupled to the top portion and the bottom portion of the strip, each of the guides having a surface with a V-shaped cross-section for slidably engaging the grooves in the side edges of the rulers a lip coupled to the strip opposite the guides and extending in substantially perpendicular relationship to the strip, a threaded aperture formed in the strip for releasably receiving a set screw for selectively engaging the front face of the ruler for securing the stop in place.

8. The nail gun of claim 7 wherein the strip is transparent.

* * * * *